United States Patent [19]

Walker

[11] Patent Number: 4,978,015

[45] Date of Patent: Dec. 18, 1990

[54] PLASTIC CONTAINER FOR PRESSURIZED FLUIDS

[75] Inventor: Larry D. Walker, Arlington, Tex.

[73] Assignee: North American Container, Inc., Allentown, Pa.

[21] Appl. No.: 463,148

[22] Filed: Jan. 10, 1990

[51] Int. Cl.[5] ..... B65D 1/02; B65D 1/42; B65D 23/00

[52] U.S. Cl. ..... 215/1 C; 220/606; 220/608; 220/609

[58] Field of Search ..... 215/1 C; 220/69 (U.S. only), 70, 604, 606, 608, 609 (U.S.only); 428/36.92

[56] References Cited

U.S. PATENT DOCUMENTS

| | | | |
|---|---|---|---|
| 3,043,461 | 7/1962 | Glassco | 215/1 C |
| 3,137,748 | 6/1964 | Makowski | 264/97 |
| 3,198,861 | 8/1965 | Marvel | 264/98 |
| 3,468,443 | 9/1969 | Marcus | 215/1 C |
| 3,511,401 | 5/1970 | Lachner | 215/1 C |
| 3,598,270 | 8/1971 | Adomaitis | 215/1 C |
| 3,643,829 | 2/1972 | Lachner | 215/1 C |
| 3,718,229 | 2/1973 | Wyeth | 215/1 C |
| 3,720,339 | 3/1973 | Khetani | 215/1 C |
| 3,722,725 | 3/1973 | Khetani | 215/1 C |
| 3,722,726 | 3/1973 | Carmichael | 215/1 C |
| 3,727,783 | 4/1973 | Carmichael | 220/70 X |
| 3,745,150 | 7/1973 | Corsover | 260/75 T |
| 3,757,978 | 9/1973 | Gilbert | 215/1 C |
| 3,759,410 | 9/1973 | Uhlig | 215/1 C |
| 3,778,214 | 12/1973 | Wyeth | 425/326 |
| 3,803,275 | 4/1974 | Corsover | 264/28 |
| 3,811,588 | 5/1974 | Vermeerbergen et al. | 215/1 C |
| 3,849,530 | 11/1974 | Wyeth et al. | 264/89 |
| 3,870,181 | 3/1975 | Sincock | 215/1 C |
| 3,871,541 | 3/1975 | Adomaitis | 215/1 C |
| 3,881,621 | 5/1975 | Adomaitis | 215/1 C |
| 3,917,095 | 11/1975 | Seefluth | 215/1 C |
| 3,926,324 | 12/1975 | Zavasnik | 215/1 C |
| 3,935,955 | 2/1976 | Das | 215/1 C |
| 3,948,404 | 4/1976 | Collins | 215/1 C |
| 3,973,693 | 8/1976 | Brocklehurst | 220/66 |
| 4,024,975 | 5/1977 | Uhlig | 215/1 C |
| 4,108,324 | 8/1978 | Krishnakumar | 215/1 C |
| 4,134,510 | 1/1979 | Chang | 215/1 C |
| 4,177,239 | 12/1979 | Gittner | 264/530 |
| 4,219,124 | 8/1980 | Amberg | 215/12.1 |
| 4,247,012 | 6/1981 | Alberghini | 220/70 X |
| 4,249,667 | 2/1981 | Pocock et al. | 220/70 X |

(List continued on next page.)

FOREIGN PATENT DOCUMENTS

| | | | |
|---|---|---|---|
| 219616 | 4/1987 | European Pat. Off. | 215/1 C |
| 225155 | 6/1987 | European Pat. Off. | 215/1 C |
| 86/05462 | 9/1986 | PCT Int'l Appl. | 220/70 |
| 87/04974 | 8/1987 | PCT Int'l Appl. | 215/1 C |
| 2067160 | 7/1981 | United Kingdom | 220/70 |
| 2189214 | 10/1987 | United Kingdom | 264/532 |

*Primary Examiner*—Sue A. Weaver
*Attorney, Agent, or Firm*—Roper & Quigg

[57] ABSTRACT

A blow-molded plastic container having a body comprising a neck portion, a generally cylindrical sidewall portion and a bottom structure. The bottom structure comprises a central portion, a plurality of ribs extending downwardly from the bottle sidewall to the central portion, and a plurality of feet extending below the central portion from the sidewall portion. The ribs are defined by an upper curvilinear surface and, in cross-section are of an substantially U-shape having a relatively tight radius, the upper rib surfaces lying on a generally hemispherical curvature in the interior of said container. Each foot is positioned between two ribs and has a pair of rib-defining endwalls connected to and continuous with the ribs on each side of a curvilinear outer wall connected to and continuous with the sidewall portion, a generally horizontal base surface joined to said outer wall, a generally vertical first inner surface forming a lip extending upwardly from the base surface, and a second inner surface extending from the lip to the central portion.

9 Claims, 5 Drawing Sheets

U.S. PATENT DOCUMENTS

| | | | |
|---|---|---|---|
| 4,254,882 | 3/1981 | Yoshino | 220/70 X |
| 4,261,948 | 4/1981 | Krishnakumar et al. | 264/532 |
| 4,267,144 | 5/1981 | Collette | 264/523 |
| 4,294,366 | 10/1981 | Chang | 215/1 C |
| 4,301,933 | 11/1981 | Yoshino | 215/1 C |
| 4,318,489 | 3/1982 | Snyder et al. | 220/70 X |
| 4,330,579 | 5/1982 | Ota et al. | 428/35 |
| 4,334,627 | 6/1982 | Krishnakumar et al. | 215/1 C |
| 4,335,821 | 6/1982 | Collette et al. | 215/1 C |
| 4,352,435 | 10/1982 | Yoshino et al. | 215/1 C |
| 4,355,728 | 10/1982 | Yoshino et al. | 215/1 C |
| 4,359,165 | 11/1982 | Jakobsen | 215/1 C |
| 4,368,825 | 1/1983 | Motill | 215/1 C |
| 4,403,706 | 9/1983 | Mahajan | 215/1 C |
| 4,436,216 | 3/1984 | Chang | 220/69 |
| 4,465,199 | 8/1984 | Aoki | 220/70 X |
| 4,467,929 | 8/1984 | Jakobsen et al. | 215/1 C |
| 4,496,064 | 1/1985 | Beck et al. | 215/1 C |
| 4,502,607 | 3/1985 | Szajna | 220/70 |
| 4,525,401 | 6/1985 | Pocock et al. | 428/64 |
| 4,598,831 | 7/1986 | Nakamura et al. | 215/1 C |
| 4,615,928 | 10/1986 | Kawaguchi et al. | 428/35 |
| 4,725,464 | 2/1988 | Collette | 428/35 |
| 4,755,404 | 7/1988 | Collette | 428/35 |
| 4,780,257 | 10/1988 | Beck | 264/40.1 |
| 4,785,949 | 11/1988 | Krishnakumar et al. | 215/1 C |
| 4,785,950 | 11/1988 | Miller et al. | 215/1 C |
| 4,796,766 | 1/1989 | Clark | 215/1 C |
| 4,850,493 | 7/1989 | Howard, Jr. | 215/1 C |
| 4,850,494 | 7/1989 | Howard, Jr. | 215/1 C |
| 4,865,206 | 9/1989 | Behm et al. | 215/1 C |
| 4,867,323 | 9/1989 | Powers | 215/1 C |
| 4,892,205 | 1/1990 | Powers | 215/1 C |

FIG. 1
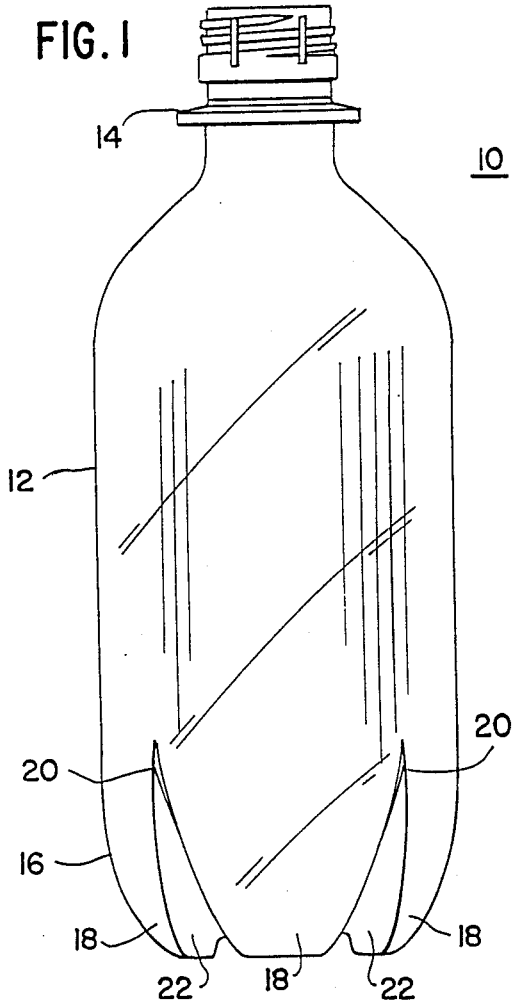
FIG. 2
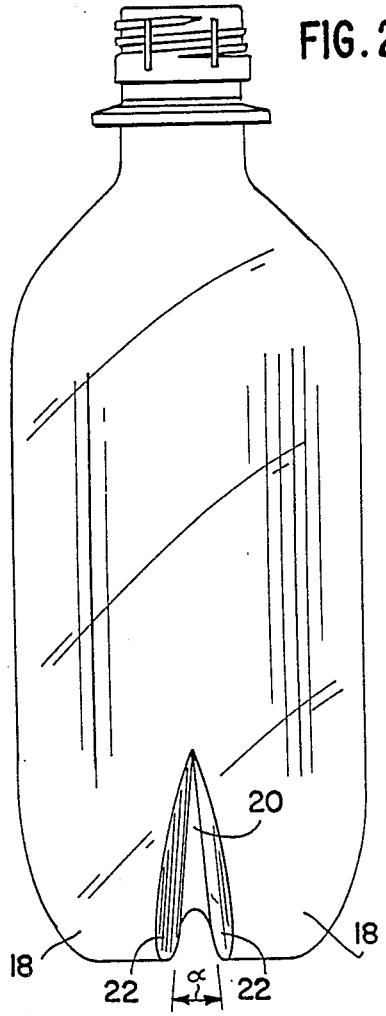
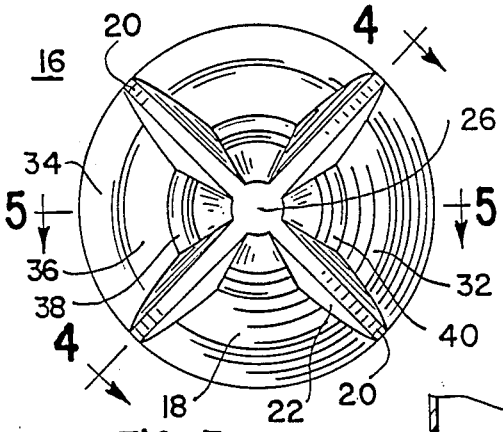
FIG. 3
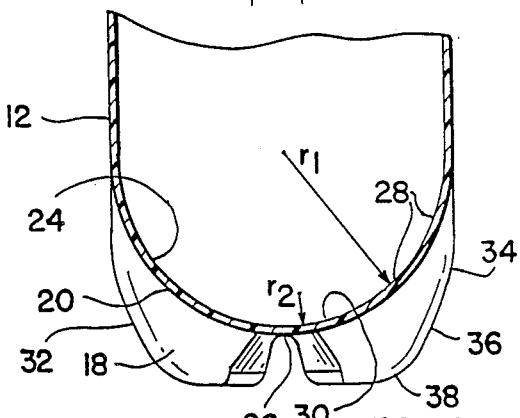
FIG. 4
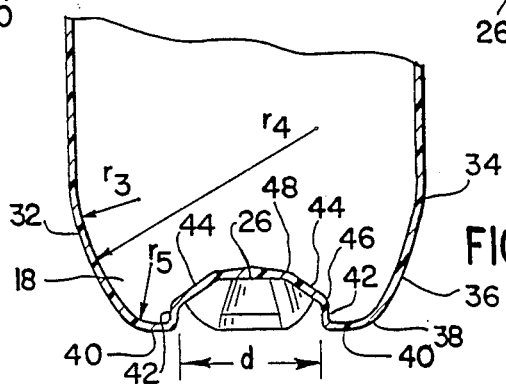
FIG. 5

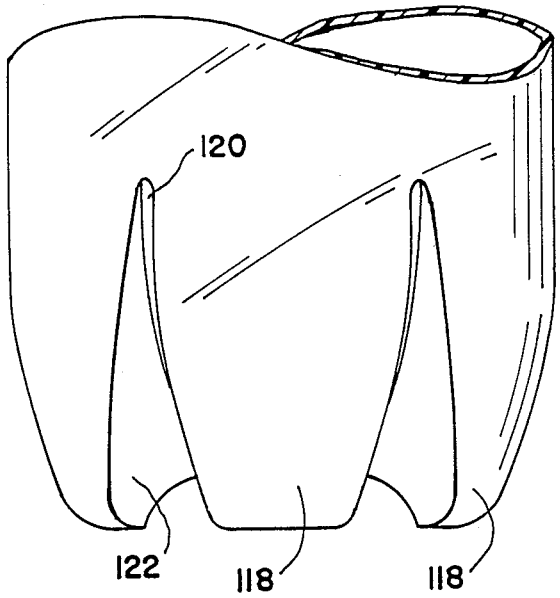
FIG. 7
116
FIG. 8
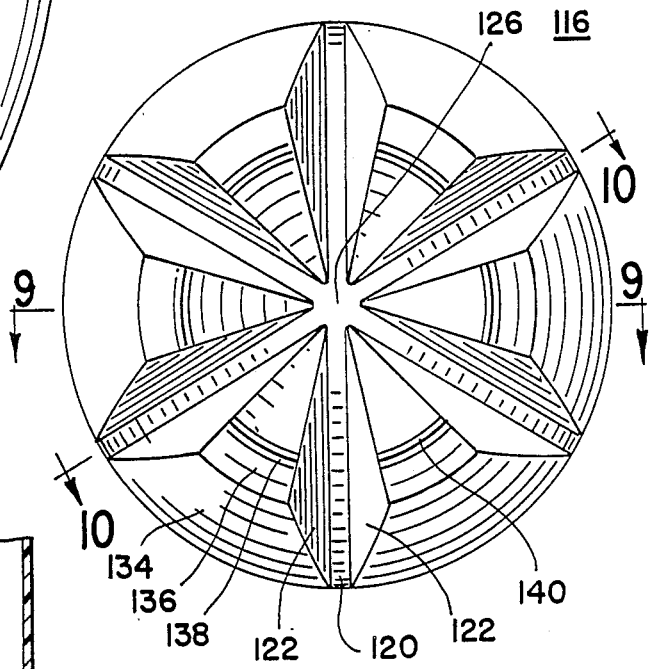
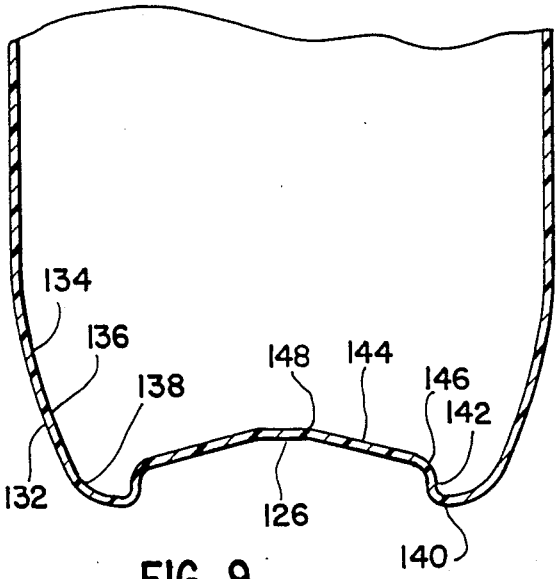
FIG. 9
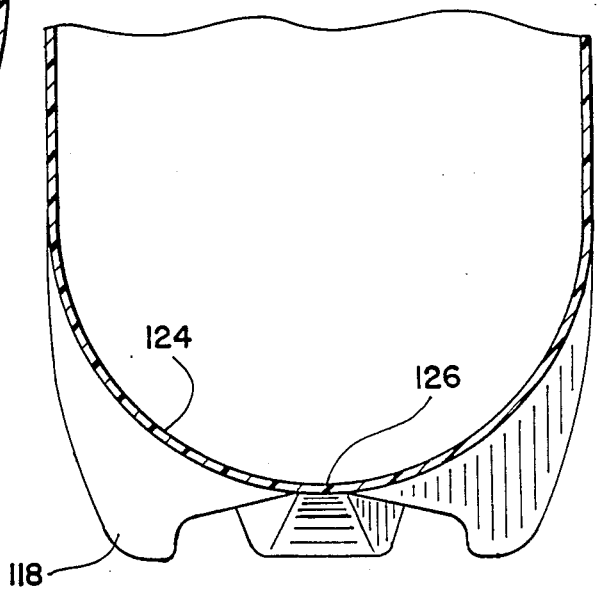
FIG. 10

PLASTIC CONTAINER FOR PRESSURIZED FLUIDS

BACKGROUND OF THE INVENTION

This invention relates to plastic containers, especially plastic containers for pressurized fluids, and more particularly, to an improved bottom structure for plastic bottles of the type suitable for containing effervescent or carbonated beverages.

Blow-molded plastic bottles for containing liquids at elevated pressures are known and have found increasing acceptance. Such containers are accepted particularly in the beverage industry for use as one-way disposable containers for use with effervescent or carbonated beverages, especially carbonated soft drinks. Plastic bottles of this type are subject to a number of structural and functional criteria which have presented many problems not previously solved. Solutions to the problems offered by the prior art have yielded bottles which are not entirely satisfactory.

Because many of the pieces of the equipment used in the handling and filling of such bottles are costly and were manufactured to work with glass bottles, attempts were made to conform the plastic bottles to the size and shape of prior art glass bottles employed for the same purpose. However, it has been found that a mere replication of the prior art glass bottles in plastic is not entirely satisfactory. The replication of the glass structure in plastic is not possible due to the resilient nature of the plastic materials and the distortion and creep which the plastic materials can exhibit at elevated pressure especially when such bottles are subjected to elevated temperatures. Further, the plastic bottle is limited to certain modification by the very nature of the blowing process and the available materials for use in forming such a bottle.

The overwhelming use for the bottles of this type are where the contained liquid will be carbonated. When used with carbonated beverages, the bottles may be subjected to internal pressures normally between 40 and 100 pounds per square inch and occasionally as high as 200 psi under severe conditions of elevated temperature, especially during transportation. In such a condition, the bottle is presented with an elevated pressure within the bottle when filled. This pressure, however, will be absent both prior to sealing and subsequent to the opening of the bottle. The potential for failure in the plastic bottle when pressurized is greatest at the bottom of the container. Various designs have been employed to effectively deal with this condition.

One of the initial plastic bottle designs had a bottom design consisting generally of a hemispherical bottom to which was added as a separate member a base cup which supports the bottle in an upright position. This design is shown for example, in U.S. Pat. No. 3,722,725. This design has been widely used and adopted in the industry. It provides a strong bottle because the hemispherical bottom is the geometric shape which most uniformly adapts to pressure. However, this basic design has several significant disadvantages.

Initially, the design requires the separate manufacture of the bottle and the base cup. It also requires the additional mechanical step of attaching the base cup to the bottle. In addition, the amount of material used in the bottle and in the base cup is beginning to cause concern among the ever more environmentally-conscious public. Compounding the environmental problem, in commercial embodiments, the bottle and base cup are generally made from dissimilar plastic materials. In such a case, the reclamation or recycling of the plastic used in the bottles is difficult if not impossible.

Due to the manufacturing and disposal problems inherent in the two-piece construction, the art turned to the manufacture of one-piece bottles. Such bottle designs have generally taken the form of bottles where the bottom design is a plurality of feet integrally formed in the base of the bottle upon which the bottle rests, for example U.S. Pat. No. 3,759,410. Other designs for one-piece bottles include a continuous peripheral seating ring upon which the bottle rests surrounding a generally concave central portion, e.g., U.S. Pat. No. 4,247,012.

In existing one-piece bottle bottom constructions three general problems have been identified in the art. Initially, such plastic bottles have not had enough bottom strength to withstand the impact of falling from a moderate height onto a hard surface when filled with a carbonated beverage. Further, because the bottles are often subjected to extreme temperatures, it has been found in some designs that the bottom of the bottle everts or otherwise distorts producing a bottle known in the industry as a "rocker" where the bottle wobbles in transportation or display. Finally, another problem is the stress cracking of such bottles, especially under extremes of temperature or pressure or when exposed to any stress cracking agent during filling, handling or transportation.

Moreover, as is known in the art, it is highly desirable that any bottle design be of a type which is aesthetically pleasing as the bottle's design is used as one feature in the marketing and sale of the contained liquid. One known bottom structure which is generally considered aesthetically pleasing is the so-called "champagne" bottom. Based upon the traditional design of glass champagne bottles, the champagne bottom has a central upwardly convex portion which extends up into the bottle interior from the continuous base which is a continuation from the bottle sidewall.

Polyethylene terephthalate (PET) is the preferred plastic used in the formation of bottles for carbonated beverages. PET is a desirable material to use in such bottles because, when properly processed it has the requisite clarity, strength, and resistance to pressure leakage necessary for such bottles. Specifically, when blow-molded, PET is essentially completely transparent. The PET material has sufficient gas barrier properties so that carbonated beverages can be stored for extended periods of time without losing any significant amount of the $CO_2$ pressure given by carbonation. Commonly, bottles are blow molded from injection molded "preforms" of PET.

Blow molded bottles formed from injection molded preforms tend to have a particularly acute stress cracking problem in the area of the bottle bottom portion which includes and lies adjacent to the nib remaining on the preform from the sprue or "gate" through which the molten polymer is injected into the preform mold. This gate area is manifest in the blow-molded bottle by a clouded circlet at or very near the center of the bottle bottom. In the prior art bottles, this gate area contains far less biaxial orientation than is present in the bottle sidewall or in the remainder of the bottom. As a result of this deficiency, the gate area of a bottle blow molded from an injection molded preform is more likely to fail under stress, particularly under the extreme conditions experienced in the transportation and storage especially in geographical areas where the ambient temperature exceeds 100° F., than other areas of the bottle sidewall and bottom. The beverage industry suffers substantial losses due to this stress-cracking problem.

Thus, the present invention provides a design for a blow-molded one-piece plastic beverage container having a bottom design overcoming the problems of the prior art. Specifically, the container of the present invention is strong enough to withstand a blow from a fall, will not evert under pressure, is resistant to stress cracking, and is aesthetically pleasing.

SUMMARY OF THE INVENTION

The present invention provides for a plastic bottle which has a neck portion, a generally cylindrical sidewall portion and a bottom structure. The neck and sidewall portions are conventional while the bottom is unique. The bottom structure comprises a plurality of ribs extending from the sidewall to a central portion of the bottom structure where the ribs intersect. The upper curvilinear surface of the ribs lie on an essentially hemispherical curve in the interior of the bottle. The bottom further comprises, alternating between the ribs, a plurality of uniquely designed feet which extend along a curved path from the sidewall, have endwalls connected to adjacent ribs and include a generally horizontal base surface.

Upon pressurization of the bottle, the radial position of the base surface from the central portion is displaced slightly outwardly and the base surface of each foot assumes a saddle-like contour with two contact points at each end of the saddle. These contact points on all the feet lie in a common horizontal plane perpendicular to the central vertical axis of bottle.

The bottom presents a pseudo-champagne appearance wherein the feet contain a substantially vertical inner surface or lip positioned radially inwardly from the base surface and connected to a second inner surface which extends from the substantially vertical lip to the central portion of the bottom structure. Thus, the inner surfaces of the feet define a pseudo-champagne dome below the central portion and below the hemispherical bottom contour defined by the upper rib surfaces.

It has been found that this structure prevents the bottom from everting and induces sufficient biaxial orientation in the bottle to improve stress crack resistance. The bottle of the present invention has sufficient strength to be able to withstand the stress of a pressurized fluid. In particular, the bottle is found to have sufficient biaxial orientation in the gate area so that the bottom is strengthened in that area.

BRIEF DESCRIPTION OF THE DRAWINGS

FIG. 1 is a side elevation view of a four-footed embodiment of a bottle constructed in accordance with the invention.

FIG. 2 is a side elevation view of the bottle of FIG. 1 rotated 45 degrees about its verticle axis from the view of FIG. 1.

FIG. 3 is a bottom view of a four-footed embodiment of the bottle of this invention.

FIG. 4 is a schematic sectional view of the bottom of the bottle taken generally along line 4—4 of FIG. 3.

FIG. 5 is a schematic sectional view of the bottom of the bottle taken generally along line 5—5 of FIG. 3.

FIG. 7 is a side elevation view of the bottom bottle of FIG. 6 rotated 30 degrees about its vertical axis from the view of FIG. 6.

FIG. 8 is a bottom view of a six-footed embodiment of the bottle of this invention.

FIG. 9 is a schematic sectional view taken generally along line 9—9 of FIG. 8.

FIG. 10 is a schematic sectional view taken generally along line 10—10 of FIG. 8.

DETAILED DESCRIPTION

Figure 6:
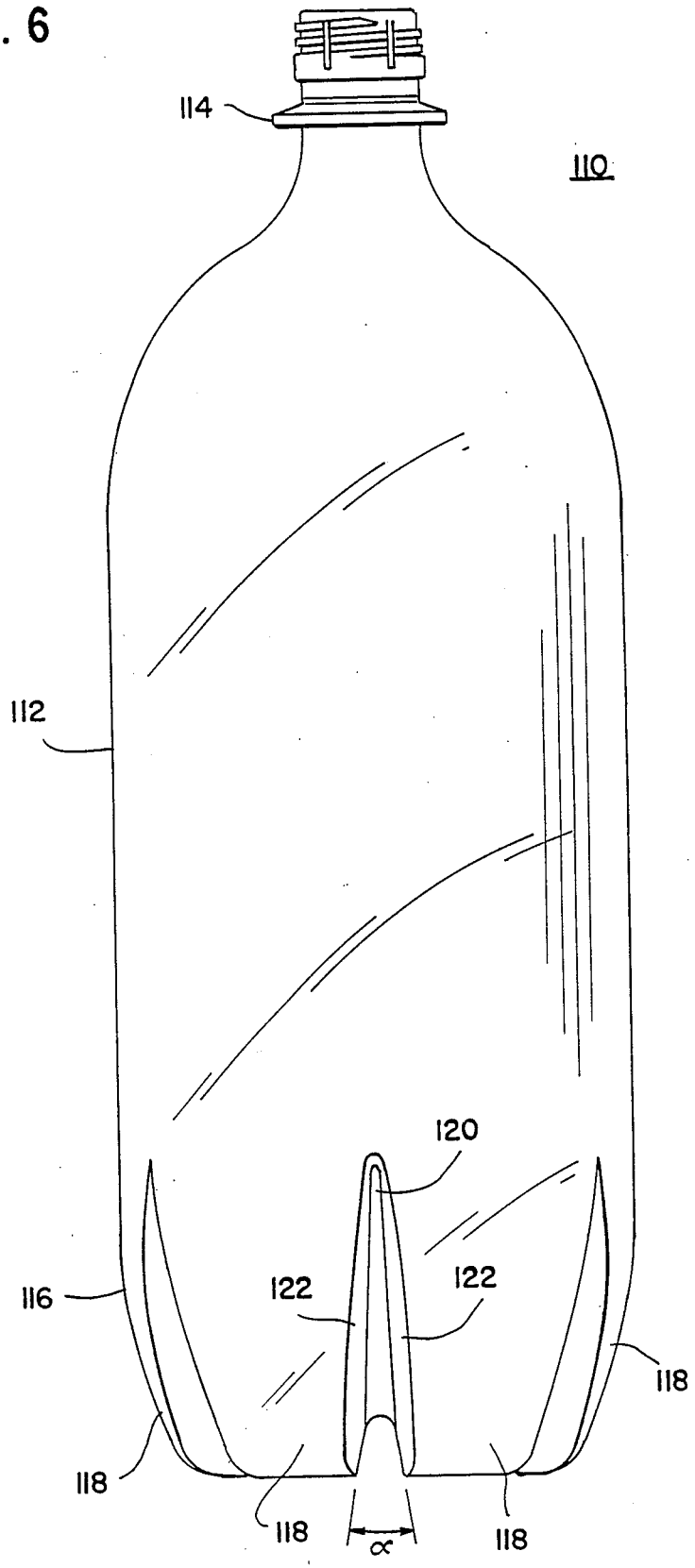
FIG. 6 is a side elevation view of a six-footed embodiment of the bottle of this invention.

The processing of the bottles of the present invention involves the injection molding of PET into what is commonly referred to as a "preform" and then blow-molding such preform into the bottle.

PET is a polymer with a combination of properties that are desirable for the packaging of carbonated beverages including toughness, clarity, creep resistance, strength, and a high gas barrier. Furthermore, because PET is a thermoplastic it can be recycled by the application of heat. Solid PET exists in three basic forms: amorphous, crystalline, and biaxially oriented.

PET in the amorphous state is formed when molten PET is rapidly cooled to below approximately 80° C. It appears clear and colorless and is only moderately strong and tough. This is the state that preforms are in upon being injection molded.

Crystalline PET is formed when molten PET is cooled slowly to below 80° C. In the crystalline state, PET appears opaque, milky-white and is brittle. Crystalline PET is stronger than amorphous PET and thus it is desirable to minimize or eliminate the presence of any crystalline material in a preform. Because crystalline PET is stronger than amorphous PET, badly formed bottles will result from the blow molding process if a significant amount of crystalline PET is present in the preform.

Oriented PET is formed by mechanically stretching amorphous PET at above 80° C. and then cooling the material. Biaxially oriented PET is usually very strong, clear, tough, and has good gas barrier properties. It is generally desirable in order to obtain sufficient biaxial orientation that the amount of stretch being applied to the amorphous PET be on the order of at least three times.

While biaxially oriented PET is exceptionally clear and resistant to stress cracking, non-biaxially oriented crystalline PET is neither clear nor resistant to stress cracking. Further, amorphous PET, although clear, is not resistant to stress cracking. One easy test used in the industry to determine the stress crack resistance of a PET bottle is to apply an acetone-containing solution to a pressurized bottle. Material which is amorphous or crystalline in nature will show cracking in a relatively short amount of time, on the order of minutes, as compared to the resistance of biaxially oriented PET.

Thus, in the design of plastic containers made of PET it is desirable to obtain as much biaxial orientation as is possible.

Various types of PET material can be used in the manufacture of the bottles of the present invention. One important measure of the PET material which is used by those skilled in the art is the intrinsic viscosity. Typical values of intrinsic viscosity for PET bottle manufacture are in the range of 0.65 to 0.85. It has been found preferable in the bottle of the present invention to use a PET material with an intrinsic viscosity of not less than 0.8.

In the present invention, a conventionally made injection-molded preform can be used. As one skilled in the art knows, various configurations of preforms for a desired bottle can be used to make various bottle designs. The use of a particular preform with a particular bottle design is a matter of design and the selection criteria are known to those of skill in the art. It may be advantageous to alter the design of the preform to optimize the final bottle. For example, it may be advantageous to taper the bottom of the preform to allow better orientation and distribution of material.

In the injection-molding of the preform the molten polymer is injected into the mold through a sprue or gate. As a result of this, a nib of polymer remains on the preform. The "gate" area of the preform, includes and lies adjacent to this nib, and tends not to be biaxially oriented to the same degree as the rest of the bottle and, therefore, tends to be a point of potential stress cracking.

Sometimes the gate area of the preform contains a small amount of crystalline material as it is difficult in the injection molding process to cool that portion of the material rapidly enough to allow it to become amorphous. More importantly, in the prior art, the gate area was not stretched when the bottle was blow-molded and, therefore, the crystallinity was deemed acceptable for the formation of an appropriate bottle. The non-oriented area must, therefore, be restricted to a very small area around the gate and even if it is so restricted, the area of crystallinity introduces potential stress cracking problems in the bottle.

The bottom structure of the present invention is such that the PET material in and around the gate area of the preform is sufficiently biaxially oriented in the blow-molding process to improve stress crack resistance over the prior art. Thus, the PET material in the entire bottle, including that material in the gate area is sufficiently stretched in molding to form a bottle which is substantially resistant to stress cracking.

The bottles of this invention can be formed by a conventional stretch blow-molding process. In such a process, biaxial orientation is introduced into the PET by producing stretch along both the length of the bottle and the circumference of the bottle. In stretch blow-molding, a stretch rod is utilized to elongate the preform and air or other gas pressure is used to radially stretch the preform, both of which happen essentially simultaneously. Prior to blow-molding, the preforms are preheated to the correct temperature, generally about 100° C., but this varies depending upon the particular PET material being used.

It is known in the art that the temperature and temperature profile of heating of the preform is important to achieve the intended distribution of the material over the bottle wall during forming. It also is well known in the art how to alter such a temperature profile to produce an acceptable bottle once the design of the mold is known. The temperature profile is used to control material distribution.

Once the PET preform is at the desired temperature it is secured by its neck in a mold which has a cavity of the desired bottle shape. A stretch rod is introduced into the mouth of the bottle to distribute the material the length of the bottle and orient the molecules of PET longitudinally. Simultaneously, air is blown into the bottle from around the stretch rod to distribute the material radially to give the radial or hoop orientation.

Air pressure pushes the bottle walls against the mold, generally water-cooled, causing the biaxially oriented PET to cool. Ideally, as is known in the art, the bottle wall should touch the mold at all points of the bottle at approximately the same time. After sufficient cooling has taken place, to avoid bottle shrinkage, the mold is opened and the bottle discharged.

Referring to FIG. 1, a container in the form of a bottle 10 is constructed having a body which comprises generally cylindrical sidewall portion 12 and a neck portion 14. The upper neck portion 14 can have any desired neck finish, such as the threaded finish which is shown, and is generally closable to form a pressurizable bottle. A bottom portion 16 is provided at the lower end of the sidewall portion 12. The bottom portion 16 comprises a plurality of feet 18. Alternating between said plurality of feet 18 are ribs 20 which extend from sidewall 12. The ribs 20 of the present invention are defined by an upper curvilinear surface. As can best be seen in FIG. 2, in cross section, ribs 20 have an inverted U-shaped cross-section with a relatively tight radius. Referring to FIGS. 1–3 it can be seen that ribs 20 are continuous and merge into endwalls 22 of feet 18.

The bottom section 16 can be comprised of four feet 18 as shown in FIGS. 1–5 or as shown in FIGS. 6–10 the bottom section 116 can be comprised of six feet 118. It is to be understood that the embodiments herein described and shown in the drawings are preferred embodiments only and the number of feet is primarily a function of the desired aesthetics. However, it is preferred to use a larger number of feet in a larger bottle to provide more ribs which provide increased stability and rigidity in the bottom section. Moreover, the number of feet used must be sufficient so that the structure of the feet as hereinafter described is able to cause the PET material within the gate area to be sufficiently stretched so as to cause biaxial orientation.

Referring to FIG. 3, the bottom section 16 is seen in a bottom view in an embodiment where there are four feet 18 with four corresponding ribs 20. As can be seen by referring to FIG. 4, the upper curvilinear surfaces 24 of ribs 20 form a generally hemispherical curve in the interior of the container 10. The ribs 20 are of a substantially inverted U-shape in cross section, and define a somewhat tight curve in order to induce biaxial orientation of the PET and provide rigid structural support in the bottom. The ribs 20 merge smoothly from the sidewall portion 12 of the bottle 10 and extend to a central portion 26 which can be seen by reference to FIGS. 3–5. The central portion 26 is generally circular in shape and includes the gate area of the preform.

The upper curvilinear surface 24 of a rib 20 follows a generally semicircular path connected to and continuous with sidewall 12 and has a radius substantially equal to the radius of the cylindrical sidewall portion 12. Alternatively, the path defined by the surface 24 of the ribs 20 can have two or more arcuate sections of differing radii or can include straight sections tangent with curved sections. For example, in FIG. 4 there is a first arcuate section 28 of radius, r1, equal to that of the cylindrical sidewall portion 12. Connected to and continuous with the first arcuate section 28 is a second arcuate section 30 of relatively smaller radius, r2. This smaller radius second arcuate section 30 is connected to and continuous with first arcuate section 28 on one end and on its other end is connected to and continuous with central portion 26. The size of the radius of arcuate portion 30 relative to arcuate portion 28 can vary, for example, in the range of from 7 to 15% of the radius of the first arcuate section 28. Also central portion 26 has an upper surface inside the bottle which is a continuation of the rib curvature, or it can be slightly flattened as produced by the contour of the stretch rod. Having a central portion 26 which is slightly domed is also within the scope of the invention.

As can be seen by referring to FIGS. 4–5, the feet 18 extend below central portion 26 and are defined on their outer surface by a curvilinear outer wall 32. This outer foot wall 32 can follow any smooth curvature from the bottle sidewall to the foot base surface 40.

In a preferred embodiment, as shown, the curvilinear outer foot wall 32 is comprised of three arcuate sections, the first arcuate section 34 of a relatively small radius, r3, the second arcuate section 36 of a relatively large radius, r4, and the third arcuate section 38 of a relatively small radius, r5. As used in connection with wall 32, relatively large radius is meant to indicate a radius of curvature well in excess of the radius of the cylindrical section 12 of the bottle and can be larger even than the diameter of the cylindrical sidewall portion 12 of the bottle. The first arcuate section 34 is connected to and continuous with the sidewall 12. Connected to and continuous with the first arcuate section 34 is the second arcuate section 36 and connected thereto is third section 38. The first arcuate section 34 is connected to and continuous with i.e., tangential to, sidewall 12. The third section 38 is connected to and continuous with, i.e., tangential to, the horizontal base surface 40 which is provided as the bottom of foot 18. In a preferred embodiment, the radii of the first and third arcuate portions 34 and 38 can be in the range of between 10 and 25% of the radius of second arcuate section 36.

The bottom of foot 18 is defined by horizontal base surface 40. The diameter d shown in FIG. 5 is the effective diameter of the contact surface of bottle 10 when the bottle is non-pressurized. As will be discussed more fully later, when pressurized, the diameter d increases to provide increased stability. The psuedo-champagne dome effect is provided by the radially inward surface of the feet 18. A generally vertical first inner surface 42 is connected to and extends upwardly from the base surface 40 forming a lip. In the embodiment shown, the first inner surface 42 is 3° off of vertical. A second inner surface 44 extends from the substantially vertical lip 42 to the central portion 26.

In a preferred embodiment, there is an arcuate transition section 46 joining the second inner surface 44 to the lip 42. A second arcuate transition section 48 is located at the opposite end of the second inner surface 44 and joins the second inner surface 44 to central portion 26. In a preferred embodiment, the angle between the plane extending horizontally through the center most point of central portion 26 and the plane defined by secondary surface 44 is between about 10° and about 35°, this angle generally being higher in smaller diameter bottles and lower in larger diameter bottles.

It has been found that the bottom structure 16 depicted in the figures provides severe enough curving and provides a mold wherein even the central portion 26 is substantially transformed into biaxially oriented material in the blow-molding process. Thus, the central portion 26, unlike in prior art embodiments, has all of the mechanical property advantages of biaxially oriented PET, especially superior stress crack resistance.

FIGS. 6–10 relate to another embodiment of the container 110 according to the present invention. The features which are the same as those described in FIGS. 1–5 have the addition of 100 to the respective reference numerals. In the embodiment shown in FIGS. 6 through 10, six feet 118, along with six ribs 120 are used. As noted above, the specific number of feet 118 used in any given embodiment is a matter of choice. However, it has been found that for a container of volume of about 16 ounces or 500 milliliters, a four-footed design is desirable. Correspondingly, for a larger container, such as a two-liter bottle, it has been found that a six-footed embodiment is preferred. While the choice of the number of feet is a design variable adjustable by those skilled in the art, it is noted that generally it is desirable to have a smaller number of feet on smaller containers so as not to require overly intricate molds which could result in a large number of malformed bottles. Correspondingly, in larger containers it is desirable to have a larger number of feet to allow the number of ribs to be sufficient to define the hemispherical curve which gives the bottle of the present invention its strength and also to create enough convolution in the bottom design to induce sufficient biaxial orientation throughout the bottom of the container, including in the gate area.

Turning to FIG. 6, it can be seen that in the six-footed embodiment of bottle 110, there is again a substantially cylindrical sidewall portion 112 a neck portion 114 of conventional construction and a bottom portion 116. The bottom portion is comprised of feet 118 and ribs 120. Referring back to FIG. 2, it has been found the angle $\alpha$ between the two rib defining endwalls 22 of adjacent feet 18 is approximately 30° for a four-footed design in a 16 ounce or 500 milliliter bottle. Correspondingly, referring to FIG. 6, it has been found that the angle $\alpha$ between two adjacent rib-defining endwall portions 122 of feet 118 is about 24°, an appropriate amount for a six-footed design in a two-liter bottle.

As shown in FIGS. 8–10, the construction of a bottle with an embodiment of six feet is substantially similar to the construction of the four-footed bottle. As seen in FIG. 8, the bottom portion 116 of the bottle 110 contains feet 118 with ribs 120. Central portion 126 can be seen in FIG. 8. As seen in FIGS. 9–10, the construction of the ribs 120 as well as the construction of the feet 118 are similar in both the four-footed and six-footed embodiments of the bottle of this invention.

The bottom construction of the bottle of the present invention not only induces sufficient biaxial orientation to increase the stress-crack resistance of the bottle, especially the gate area of the bottle, above the prior art, but also produces a pseudo-champagne bottom which is prevented from everting even under the highest pressures generally experienced by such bottles. When the bottle of FIG. 1 was filled with carbonated fluid and pressurized, the bottom did not evert.

Figure 12:
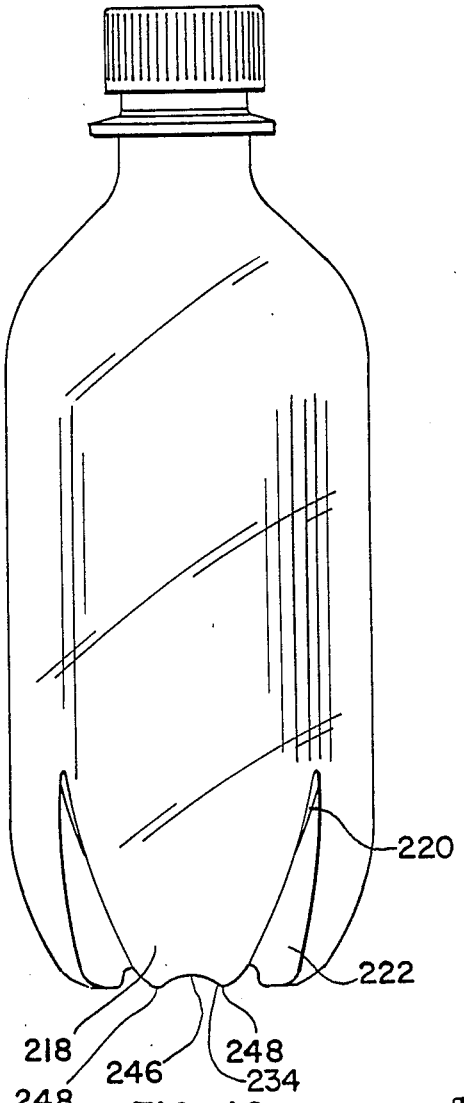
FIG. 12 is the side elevation of the bottom of the bottle of FIG. 1 when the bottle is pressurized.
Figure 13:
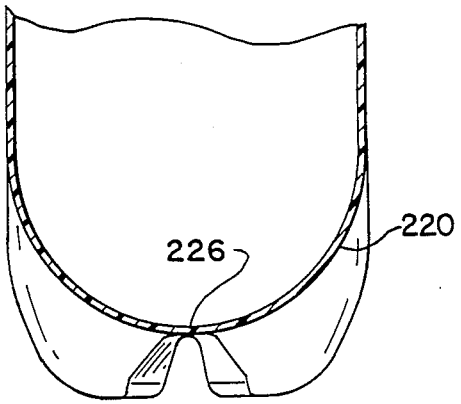
FIG. 13 is a schematic sectional view of FIG. 4 showing the bottom when the bottle is pressurized.
Figure 11:
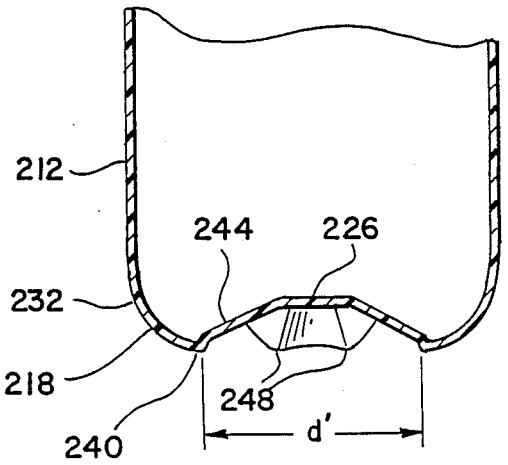
FIG. 11 is a schematic sectional view of FIG. 5 showing the bottom when the bottle is pressurized.

Under pressure, the structure of the bottom does alter slightly as shown in FIGS. 11–12. As seen in FIG. 11, when pressurized, the curvature of the curvilinear outer wall 232 of the foot 218 changes so that the horizontal base surfaces 240 are moved radially outwardly toward the sidewall portions. This results in the effective diameter d' of the base of the bottle increasing from the diameter d as shown in FIG. 5. Generally, diameter d' is approximately 8–10% greater than diameter d. Moreover, as seen in FIG. 13, even when central portion 226 is slightly flattened in an unpressurized bottle, the pressure exerted on central portion 226 in a pressurized bottle results in the depression of central portion 226 to form a more nearly perfect hemispherical curve as defined by the upper surfaces 224 of ribs 220 in the pressurized bottle. In so doing the second inner surface 244 of the foot 218 substantially decreases in angle as compared to the plane defined horizontally through the center point of central portion 226 as best seen in FIG. 11. It is to be noted that the curvilinear outer foot wall 232 does not extend radially outside the sidewall 212 of the bottle. Any bulge in wall 232 extending past the diameter of the sidewall portion 212 would be undesirable from both an aesthetic and transportation point of view.

As seen in FIGS. 11 and 12, when the bottle is pressurized foot 218 takes on a saddle-like configuration with the base surface 234 turning into an curved surface 246 with two contact points 248 at each end of foot 218. This saddle-like contour of foot 218 results in further stability in the bottle 210 and further aesthetically pleasing characteristics. Furthermore, when the bottle is pressurized, the angle $\alpha$ between adjacent rib wall-defining endwall portions 222 of feet 218 increases over the $\alpha$ of the non-pressurized bottle resulting from the fact that these end walls spread somewhat. Thus, the bottom configuration of the present invention results in a stable, strong, stress-crack resistant, aesthetically pleasing bottle.

Figure 14:
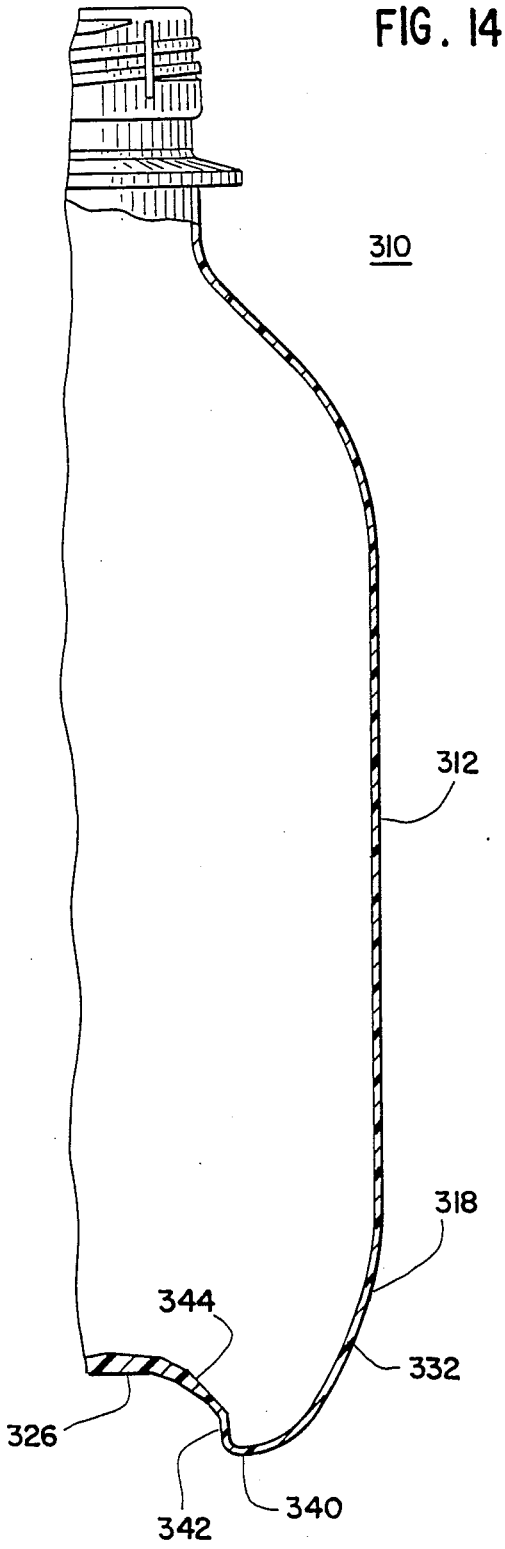
FIG. 14 is a fragmentary sectional view of the bottle of the invention showing typical wall cross section.

As shown in FIG. 14 and as previously described, the positioning of the material within the final blow-molded container product can be controlled by the temperature control on the preform used in the blow-molding process. As shown in FIG. 13, in a typical cross-section of the bottle 310, the thickness of the curvilinear outer wall 332 of the foot 318 varies from the thickness of the sidewall 312 of the container 310 and also varies as the foot progresses to its base 340 and to its lip 342, second inner wall 344 and central portion 326. Other combinations of bottom wall thickness gradation are possible. One of the significant advantages of the present invention is that less PET is required in the manufacture of the bottles than in prior art bottles. Thus, the aforementioned property advantages are augmented by significant cost savings.

Having described the invention, what is claimed is:

1. A blow-molded plastic container having a body comprising a neck portion, a generally cylindrical sideway portion and a bottom structure, said bottom structure comprising:

a central portion;

a plurality of ribs extending downwardly from said sidewall portion to said central portion, wherein each of said ribs is defined by an upper curvilinear surface and, in cross-section each rib is of a substantially inverted U-shape having a relatively tight radius, said upper rib surfaces lying on a generally hemispherical curvature in the interior of said container; and a plurality of feet extending below said central portion from said sidewall portion, each foot positioned between two of said plurality of ribs and having a pair of rib-defining endwalls connected to and continuous with the ribs on each side, a curvilinear outer wall connected to and continuous with said sidewall portion, a generally horizontal base surface joined to said outer wall, a generally vertical first inner surface forming a lip extending upwardly from the base surface, and a second inner surface extending from said lip to said central portion.

2. The container of claim 1 wherein said curvilinear outer foot wall comprises a first arcuate section of a relatively small radius connected to and continuous with said sidewall portion, a second arcuate section of a relatively large radius continuous with said first arcuate section and, extending from the outer end of said second arcuate section a third arcuate section of relatively small radius joined to said base surface wherein said first, second and third arcuate sections are continuous.

3. The container of claim 1 wherein said second inner foot surface comprises a first arcuate portion extending from said lip, a second portion continuous with said first arcuate portion, said second portion being substantially straight and a third arcuate portion extending from said second portion to said central portion.

4. The container of claim 1 wherein said upper curvilinear surface of said ribs between said sidewall portion and said central portion comprises adjacent said sidewall portion a first arcuate portion of a radius substantially equal to the radius of said cylindrical sidewall portion and a second arcuate portion of smaller radius.

5. The container of claims 1, 2, 3, or 4 wherein the plastic is polyethylene terephthalate.

6. The container of claim 5 wherein the intrinsic viscosity of the polyethylene terephthalate is at least about 0.8.

7. The container of claim 1 formed from an injection-molded preform, said preform having a gate area, where said central portion includes the gate area of said preform.

8. A container made by blow-molding an injection-molded preform of thermoplastic, said preform having a gate area and said preform being biaxially-orientable on stretching, and having a closeable neck portion, a sidewall portion and a bottom portion, together forming a pressurizable volume, said bottom portion comprising:

a central portion which includes the gate area remaining from said preform;

a plurality of inverted U-shaped ribs extending downwardly from said sidewall portion to said central portion along a hemispherical curve; and a downwardly extending foot between each pair of ribs said foot having a lowermost base surface, a curved outer wall connecting said base surface to said sidewall portion, two endwalls each connected to adjacent ribs, and an inner wall connecting said base surface to said central portion, said inner wall and outer wall contoured so that, when said container is pressurized, said base surface is displaced radially outward and is drawn into a saddle-shaped contour with a lowermost contact point at each end of said saddle-shaped contour.

9. The container of claim 1 or 8 under internal pressure provided by the carbonation of a contained beverage.

* * * * *

UNITED STATES PATENT AND TRADEMARK OFFICE

CERTIFICATE OF CORRECTION

PATENT NO. : 4,978,015

DATED : December 18, 1990

INVENTOR(S) : Larry D. Walker

It is certified that error appears in the above-identified patent and that said Letters Patent is hereby corrected as shown below:

IN THE ABSTRACT:

At line 9, delete "an" and insert therefor --a--.

At column 9, line 26, delete "an" and insert therefor -- a --.

At column 9, lines 56-57, delete "sideway" and insert therefor -- sidewall --.

At column 10, line 18, delete "outer" and insert therefor -- other --.

Signed and Sealed this

Fifteenth Day of June, 1993

*Attest:*

Michael K. Kirk

MICHAEL K. KIRK

*Attesting Officer*

*Acting Commissioner of Patents and Trademarks*